US007644545B2

(12) United States Patent
Mankell et al.

(10) Patent No.: US 7,644,545 B2
(45) Date of Patent: Jan. 12, 2010

(54) INSULATION BATT HAVING INTEGRAL BAFFLE VENT

(75) Inventors: Kurt O. Mankell, Blue Bell, PA (US); R. Allan Snyder, Eagleville, PA (US); Husnu M. Kalkanoglu, Swarthmore, PA (US); Mark Trabbold, Harleysville, PA (US); Nick Flocco, Pottstown, PA (US); Kenneth D. Knapp, Norristown, PA (US)

(73) Assignee: Certainteed Corporation, Valley Forge, PA (US)

( * ) Notice: Subject to any disclaimer, the term of this patent is extended or adjusted under 35 U.S.C. 154(b) by 586 days.

(21) Appl. No.: 10/996,225

(22) Filed: Nov. 23, 2004

(65) Prior Publication Data

US 2006/0117686 A1 Jun. 8, 2006

(51) Int. Cl.
*E04B 7/00* (2006.01)
*F24F 7/02* (2006.01)

(52) U.S. Cl. ..... 52/95; 52/302.1; 52/96; 454/260; 454/366

(58) Field of Classification Search ..... 52/95, 52/198, 199, 302.1, 407.3, 309.1, 302.3, 52/407.1, 96, 309.8, 404.1; 454/250, 260, 454/365, 366
See application file for complete search history.

(56) References Cited

U.S. PATENT DOCUMENTS 2,284,229 A * 5/1942 Palmer ..... 52/578
2,330,941 A * 10/1943 Acuff, Jr. ..... 52/407.1
2,477,152 A 7/1949 Stevenson
2,910,150 A * 10/1959 Roseman ..... 52/508
3,222,697 A * 12/1965 Scheermesser ..... 428/160
3,547,839 A 12/1970 Tocker
3,797,180 A * 3/1974 Grange ..... 52/95
3,862,527 A 1/1975 Peterson
3,863,553 A * 2/1975 Koontz ..... 454/260
3,884,009 A * 5/1975 Frohlich et al. ..... 52/745.06
3,972,164 A * 8/1976 Grange ..... 52/95
4,007,672 A 2/1977 Luckey
4,016,700 A 4/1977 Blomstedt
4,069,628 A * 1/1978 Kreimer ..... 52/94
4,096,790 A * 6/1978 Curran ..... 454/260
4,102,092 A * 7/1978 Ward ..... 52/95
4,114,335 A 9/1978 Carroll (Continued)

FOREIGN PATENT DOCUMENTS

CA 2159869 1/1997

(Continued)

OTHER PUBLICATIONS

Owens-Corning/Perma-R, Trade Literature, 1 page, undated.

(Continued)

*Primary Examiner*—Richard E Chilcot, Jr.
*Assistant Examiner*—Alp Akbasli
(74) *Attorney, Agent, or Firm*—Duane Morris LLP

(57) ABSTRACT

A baffled insulation product for ventilating air under a roof from an open space is provided comprising an elongated insulation mat having top and bottom major surfaces, the top major surface facing the roof when the product is installed in the open space, the insulation mat having a baffle integral therewith proximate to the top major surface, comprising at least one airflow channel for the ventilating air.

21 Claims, 5 Drawing Sheets

U.S. PATENT DOCUMENTS 4,125,971 A * 11/1978 Ward ..... 52/95
4,126,973 A 11/1978 Luckey
4,184,416 A * 1/1980 Koontz ..... 454/260
4,197,683 A 4/1980 Ward
D256,157 S * 7/1980 Ward ..... D23/393
4,214,510 A * 7/1980 Ward ..... 454/260
4,237,672 A 12/1980 Peterson
4,265,060 A * 5/1981 Woodhams ..... 52/95
4,280,399 A 7/1981 Cunning
D261,031 S * 9/1981 Ward ..... D23/393
4,325,290 A * 4/1982 Wolfert ..... 454/365
4,406,095 A 9/1983 Slavik
4,424,650 A * 1/1984 Van Note ..... 52/96
4,446,661 A 5/1984 Jonsson et al.
4,555,982 A * 12/1985 Goubaud ..... 454/366
4,660,463 A 4/1987 Bottomore et al.
4,776,262 A * 10/1988 Curran ..... 454/260
4,817,506 A * 4/1989 Cashman ..... 454/365
4,825,089 A * 4/1989 Lindsay ..... 250/515.1
4,903,445 A 2/1990 Mankowski
4,942,699 A 7/1990 Spinelli
4,957,037 A * 9/1990 Tubbesing et al. ..... 454/366
4,977,714 A * 12/1990 Gregory, Jr. ..... 52/95
5,007,216 A * 4/1991 Pearson ..... 52/94
5,052,286 A * 10/1991 Tubbesing et al. ..... 454/365
5,069,950 A * 12/1991 Crookston, Sr. ..... 428/156
5,094,054 A * 3/1992 Arends ..... 52/95
5,167,579 A * 12/1992 Rotter ..... 454/365
5,238,450 A * 8/1993 Rotter ..... 454/260
5,341,612 A * 8/1994 Robbins ..... 52/95
5,425,672 A * 6/1995 Rotter ..... 454/365
5,433,050 A * 7/1995 Wilson et al. ..... 52/302.1
5,596,847 A * 1/1997 Stephenson ..... 52/198
5,600,928 A 2/1997 Hess et al.
5,673,521 A 10/1997 Coulton et al.
5,867,956 A * 2/1999 Gregory et al. ..... 52/309.13
5,960,595 A 10/1999 McCorsley, III et al.
5,996,289 A * 12/1999 Allaster ..... 52/95
6,023,915 A 2/2000 Colombo
6,145,255 A * 11/2000 Allaster ..... 52/95
6,185,895 B1 * 2/2001 Rettew ..... 52/528
6,279,293 B1 * 8/2001 Ojala ..... 52/794.1
6,346,040 B1 2/2002 Best
6,347,991 B1 2/2002 Bogrett et al.
6,357,185 B1 3/2002 Obermeyer et al.
6,361,434 B1 * 3/2002 Brandon ..... 454/365
6,421,967 B1 * 7/2002 Wlaker ..... 52/198
6,754,995 B1 * 6/2004 Davis et al. ..... 52/95
6,773,341 B2 * 8/2004 Cedergreen et al. ..... 454/365
6,780,099 B1 * 8/2004 Harper ..... 454/186
6,804,922 B1 * 10/2004 Egan ..... 52/408
6,881,144 B2 4/2005 Hansen et al.
D511,848 S 11/2005 Ciepliski
6,991,535 B2 * 1/2006 Ciepliski et al. ..... 454/365
7,017,315 B2 * 3/2006 Corwin ..... 52/407.3
7,094,145 B2 * 8/2006 Rye et al. ..... 454/366
2004/0134137 A1 * 7/2004 Geer et al. ..... 52/95
2004/0266331 A1 * 12/2004 Hansen et al. ..... 454/365
2005/0054284 A1 * 3/2005 Ciepliski et al. ..... 454/365
2005/0072072 A1 * 4/2005 Duncan et al. ..... 52/198
2005/0160684 A1 * 7/2005 Duncan ..... 52/95
2005/0215192 A1 * 9/2005 Rye et al. ..... 454/260
2006/0052051 A1 * 3/2006 Daniels, II ..... 454/365
2006/0105699 A1 * 5/2006 Kortuem et al. ..... 454/260
2007/0072540 A1 * 3/2007 Ciepliski et al. ..... 454/365
2007/0094966 A1 * 5/2007 Snyder et al. ..... 52/309.1

FOREIGN PATENT DOCUMENTS

CA 2320590 3/2002
CA 2482054 3/2005
CA 2501920 5/2005
GB 2145756 A 4/1985

OTHER PUBLICATIONS

DiversiFoam, Trade Literature, 1 page, undated.
Apache, Trade Literature, 1 page, undated.
ADO Products, Trade Literature, 1 page, undated.
Meyer, Trade Literature, 1 page, undated.
Practiv/Tenneco, Trade Literature, 1 page, undated.
Johns-Manville, Trade Literature, 1 page, undated.
Shelter Enterprises, Trade Literature, 1 page, undated.
Moore Products, Trade Literature, 1 page, undated.
Owens-Corning, Raft-R-Mate®, Attic Rafter Vents, Trade Literature, 1 page, Sep. 27, 2006.
Owens-Corning, FoamulaR, Trade Literature, 2 pages, Feb. 1999.
DiversiFoam, trade literature, 4 pages, undated.
Cobra® Ridge Vent Ventilation System, product information, 2 pages, www.pacesupplycorp.com/roofing_vent_cobra.htm, accessed Aug. 27, 2004.
Cobra® (for warmer climates) Ridge Vent II™ Exhaust Vent for Roof Ridge and Cobra® (for harsh winter climates) SnowCountry™ Rigid Exhaust Vent for Roof Ridge, product information, one page, undated.
Cobra® Exhaust Vent for Roof Ridge, product information, one page, undated.
Benjamin Obdyke, installation instructions for vent chutes for cathedral ceilings, one page, undated.
Specifications for Roll Vent® Standard, Benjamin Obdyke, spec. sheet, 2 pages, 2003.
Roll Vent® Attic Ventilation System, product information www.pacesupplycorp.com/roofing_vent_rollvent.htm, 2 pages, accessed Aug. 27, 2004.
Roll Vent® Continuous Ridge Vent, product details, www.benjaminobdyke.com/html/rollvent/rv.html, accessed Aug. 27, 2004.

* cited by examiner

INSULATION BATT HAVING INTEGRAL BAFFLE VENT

CROSS-REFERENCE TO RELATED APPLICATION(S)

This application is related to commonly assigned U.S. patent application Ser. No. 10/666,657 to Richard Duncan and Dustin Ciepliski, entitled "Baffled Attic Vent Including Method of Making and Using Same"filed Sep. 19, 2003, now U.S. Pat. No. 7,302,776, the entirety of which is hereby incorporated by reference herein.

FIELD OF THE INVENTION

The present invention relates to insulation products for vented air spaces, vented insulation product installations and methods of installing insulation products for vented air spaces.

BACKGROUND OF THE INVENTION

With an increasing emphasis on energy efficiency, attic insulation has often been supplemented by blown, loose-fill insulation, or by additional or thicker insulation batts to prevent heat loss in the winter and cool air loss in the summer. Unfortunately, thicker attic insulation can lead to poor air circulation when the spaces between the roof joists and the top wall plate of the building are closed or obstructed. These spaces must be left open to provide air flow between the soffit area and the attic space, for reducing excess humidity, condensation and heat, which have been known to deteriorate roofing and structural components.

Ventilation can also help reduce the roof deck temperature to prevent damage to the roof deck and roofing shingles that can result from excessive heat in the summer and ice dam leaks in the winter. Roof ventilation is required by most building codes and by shingle manufacturers to validate warranties.

Venting moisture from the ceiling cavity is particularly a problem in cathedral ceilings, where moisture can migrate into the ceiling cavity from the open living area, especially when there is no vapor barrier installed on the interior side of the ceiling. In order to keep cathedral and non-cathedral ceiling cavities open, and thereby provide a channel for air flow, baffled vents have been installed to promote ventilation. Vented cathedral ceilings are often built in a time consuming two-step application process. The installer first places baffle vents or air chutes from the eaves of the ceiling to the ridge and then staples the baffles or air chutes to the roof sheathing between the roof rafters. The vent or chute creates a maintainable channel for ventilating air and entrained moisture. Batt insulation is then installed inwardly and adjacent to the baffle vent.

There is a need, therefore, for an improved insulation product that reduces installation complexity. Still further, there is a need for an insulation product that promotes improved ventilation.

SUMMARY OF THE INVENTION

A baffled insulation product for ventilating air under a roof from an open space to another location is provided comprising an elongated insulation mat having top and bottom major surfaces, the top major surface facing the roof when the product is installed in the open space, the insulation mat having a baffle integral therewith proximate to the top major surface comprising at least one airflow channel for the ventilating air.

The baffled insulation product of the present invention greatly reduces labor and time associated with providing ventilated attic spaces. With the new insulation product, no baffle need be installed separately from the chosen insulation material. The baffled insulation product promotes ventilation in the attic and other open spaces by maintaining an open ventilation channel through to the soffit area. The insulation product also may allow for improved migration of water vapor from the insulation mat into the ventilating air stream.

In one embodiment, the product includes a baffle section adhered to the insulation mat proximate to the top major surface thereof. The baffle section comprising a central panel having a roof facing side and an insulation mat facing side. The central panel comprises a bottom wall portion having an integral baffle surface thereon defining at least one airflow channel for the ventilating air, wherein the central panel portion is vapor permeable.

A method of ventilating air under a roof between a soffit area of the roof and an attic space is also provided comprising the following steps: (a) providing an insulation product as described above; (b) providing a building having an enclosed room partially defined by an outer wall, a horizontal top wall plate, a room ceiling, parallel inclined roof rafters, spaced from each other by a predetermined distance, supported above the wall plate, and roof sheathing fastened on upper edges of the rafters; and (c) disposing the insulation product between a pair of adjacent roof rafters, with the top major surface of the insulation mat facing the roof sheathing, and below the roof sheathing, wherein the baffle is disposed proximate to a soffit area so as to provide for air ventilation from the soffit area to an attic space.

The above and other features of the present invention will be better understood from the following detailed description of the preferred embodiments of the invention that is provided in connection with the accompanying drawings.

BRIEF DESCRIPTION OF THE DRAWINGS

The accompanying drawings illustrate preferred embodiments of the invention, as well as other information pertinent to the disclosure, in which.

DETAILED DESCRIPTION

A baffled insulation product for ventilating air under a roof from an open space is described herein in connection with FIGS. 1-8. The insulation product has a top and bottom major surfaces, where the top surface faces the roof when the product is installed in the open space, such as an attic space. The top major surface has a baffle integral therewith (e.g., formed therein or coupled thereto) comprising at least one airflow channel that provides a continuously open space through which air can easily flow, such as for allowing or directing the flow of ventilating air.

Figure 1:
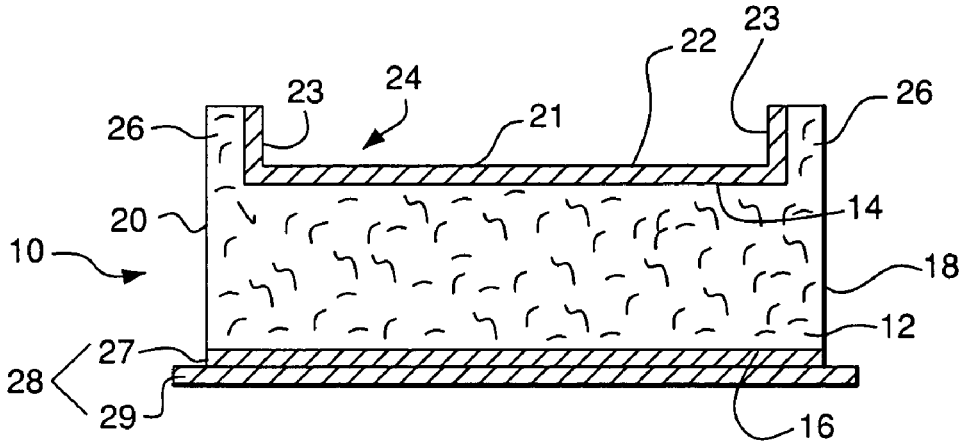
FIG. 1 is a front elevation, cross-sectional view of a first embodiment of an insulation product having a foam or sheet plastic integral baffle.

FIG. 1 is a front elevation, cross-sectional view of a first embodiment of a baffled insulation product 10. The baffled insulation product 10 includes an insulation blanket, mat or batt 12 (hereinafter referred to as mat 12) having top and bottom major surfaces 14, 16, respectively, and a pair of longitudinal side portions 18 and 20. The top major surface 14 has a baffle section 22 formed integrally therewith. The baffle 22 forms at least one channel 24 proximate to the top major surface 14 of the insulation mat 12 for allowing for the passage of ventilating air when the product 10 is installed in an open space, such as an attic space.

Insulation materials for forming mat 12 preferably comprise light weight, flexible and resiliently compressible foams or nonwoven fiber webs. Generally, these insulating materials have densities in the range of about 0.5-7 lb/ft$^3$ (8-112 kg/m$^3$), preferably in the range of about 0.5-6 lb/ft$^3$ (8-96 kg/m$^3$), and even more preferably about 1-4 lb/ft$^3$ (16-64 kg/m$^3$). Foam and nonwoven fiber web materials are usually provided in continuous sheeting that is sometimes cut to preselected lengths, thus forming batts. The thickness of the insulation mat is generally proportional to the desired insulated effectiveness or "R-value" of the insulation. These low density insulation mats typically have a thickness between about 3.5-10 inches.

Mat 12 is preferably formed from organic fibers such as polymeric fibers or inorganic fibers such as rotary glass fibers, textile glass fibers, stonewool (also known as rockwool) or a combination thereof. Mineral fibers, such as glass, are preferred. The insulation mat 12 is typically formed from glass fibers, often bound together with a heat cured binder, such as known resinous phenolic materials, like phenolformaldehyde resins or phenol urea formaldehyde (PUFA). Melamine formaldehyde, acrylic, polyester, urethane and furan binder may also be utilized in some embodiments.

Baffle 22 can take on any number of shapes, as long as at least one channel is formed integral with the mat 12. In one embodiment, shown in FIG. 1, the baffle has a generally squat U-shaped cross section, although other shapes are certainly contemplated, such as more rounded shapes, such as arcs, or corrugated shapes that provide more than one channel 24, such as a generally W-shaped cross-section. In one embodiment, the channel has a depth of about 1-2".

Baffle 22 can comprise several different materials, including, by way of example only, foamed plastic, unfoamed plastic sheeting, such as PVC (polyvinylchloride) or polypropylene, wood, sheet metal, and cardboard. A foamed plastic, such as polyurethane, polyolefin, or polystyrene foam is preferred. An advantage of using a foamed plastic for baffle 22 is that the foamed plastic can contribute to the R-value of the product. Suitable flame resistant materials, such as tris(2,3-dibromopropyl)phosphate, hexabromocyclododecane or equivalent material can be added to the base material. The baffle section 22 can be manufactured by vacuum forming, injection molding, or a combination of extrusion and a forming step such as belt forming, in which the belt has a mold impression in it, or by simply unrolling a sheet material and forming it into the mat.

In the embodiment of FIG. 1, the baffle section 22 is preferably fitted between wings 26 along the entire length of the mat 12 and is thus generally between about 2-10 feet in length and preferably between about 1-3 feet in width, in certain embodiments. The baffle can be secured by a friction fit between wings 26, but is more preferably adhered to the top major surface 14 and/or wings 26 via an adhesive, or melt-bond.

In one embodiment, the baffle 22 comprises a foam material and includes a radiant heat reflective top surface facing (not shown) with an emissivity of less than 0.10, and preferably less than 0.05, such as an aluminized film, which faces the roof (i.e., away from the insulation mat 12) when installed. This aluminized film inside surface serves to reduce the radiant heat transfer between the baffle and the roof deck. In one embodiment, the film is aluminized oriented polypropylene (OPP). An example of OPP is model MO115821 available from Dunmore Corp. of Bristol, Pa. The film may also be aluminized polyester (PET-M), such as available from Phoenix Films Inc. of Clearwater, Fla. In another embodiment, the reflective facing comprises a Foil/Scrim/Kraft (FSK) layer, such as model FB30 available from Compac Corporation of Hackettstown, N.J., or an aluminum foil layer.

In some embodiments, a vapor retarder facing layer 29, which may be a cellulosic paper, typically formed from Kraft paper, coated with a bituminous adhesive material, such as asphalt, or a polymeric film, such as low density polyethylene (LDPE), is provided on bottom major surface 16 of the insulation blanket or mat 12. The facing layer 29 and bituminous layer 27 together form bitumen-coated Kraft paper 28. The coating is preferably applied in a sufficient amount so as to provide an effective barrier or retarder for water vapor, for example, so as to reduce the water vapor permeability of the preferred Kraft paper to no more than about one perm when tested by ASTM E96 Method A test procedure.

Figure 1A:
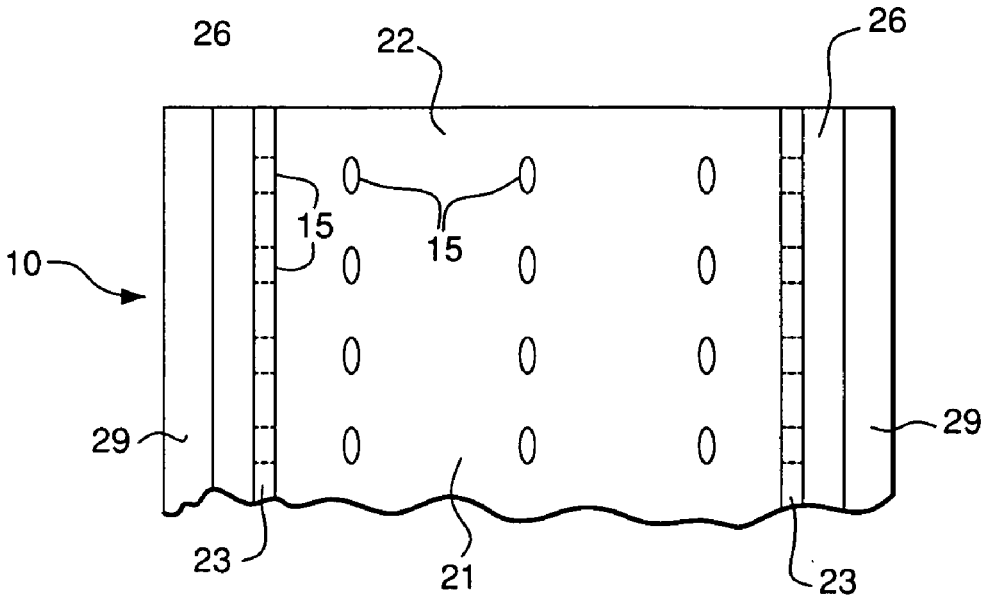
FIG. 1A is a partial, top plan view of the insulation product of FIG. 1.

In a preferred embodiment, the baffle 22, such as a foam or unfoamed plastic baffle, includes a plurality of spaced protrusions or holes 15 (shown in the top plan view of FIG. 1A) extending therethrough that help facilitate the passage of moisture that gets past the vapor barrier and into the insulation mat 12 from the insulation mat 12 through the baffle 22 and into the ventilating air stream. These holes can be of any size and spacing and be formed before, during or after affixing the baffle 22 to the insulation mat 12. In one embodiment, the holes or protrusions 15 are provided on both the horizontal bottom wall 21 of the baffle 22 and on the vertical side walls 23.

In product 10, the insulation mat 12 has a channel for receiving baffle 22 formed in the mat itself that is shaped roughly like baffle channel 24. This channel can be formed during manufacture of the mat in the forming section or cut or otherwise formed into an already formed insulation mat. The baffle 22 is then fitted between longitudinal wing portions 26 defining the walls of the channel in the mat 12. The baffle 22 is preferably secured to the top major surface 14 and/or wings 26 with an adhesive, such as a hot melt adhesive, urethane moisture cured adhesive or water-based latex adhesive. Alternatively, the baffle 22 could be mechanically fastened, or otherwise secured in association with or proximate to the top major surface of the insulation product.

Figure 2:
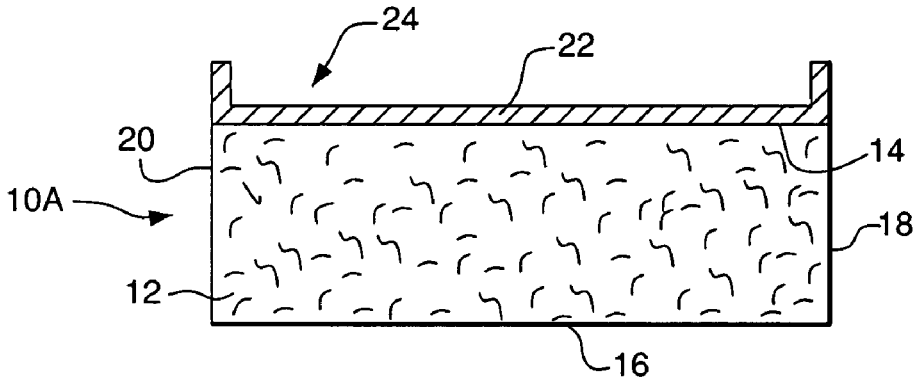
FIG. 2 is a front elevation, cross-sectional view of a second embodiment of an insulation product having a foam or sheet plastic integral baffle.

In an alternative embodiment of an insulation product 10A shown in FIG. 2, the top major surface 14 is substantially planar (i.e., does not include a channel cut or otherwise formed therein). In this embodiment 10A, the baffle 22 is directly mechanically fastened, adhered or meltbonded to the planar top major surface 14 as shown in FIG. 2.

Figure 3:
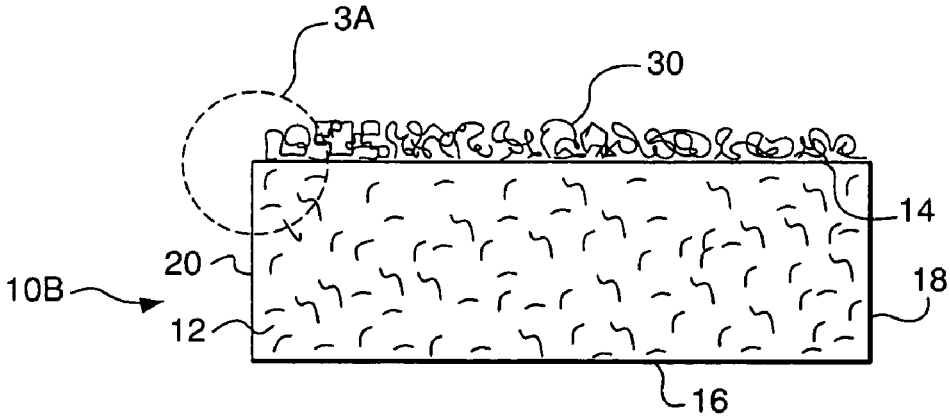
FIG. 3 is a front elevation, cross-sectional view of an insulation product having an integral baffle comprising a non-woven ventilation mesh or matting.
Figure 3A:
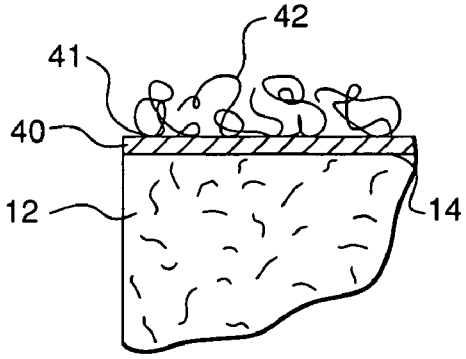
FIG. 3A is an enlarged, partial view of the insulation product of FIG. 3.

In yet another alternative embodiment of a baffled insulation product 10B shown in FIGS. 3 and 3A, the baffled insulation product 10B includes a non-woven matting or ventilation mesh layer 30 of randomly oriented filaments (such as plastic fibers) or wires 42 coupled to a substrate 40, which is in turn coupled to the top major surface 14. The matting or ventilating mesh 30 provides for air flow in both the horizontal and vertical directions. The matting or ventilating mesh 30 provides a porous space to allow for the easy movement of air, specifically the ventilating air in an open space where the insulation product 10B is installed. The mat or ventilating mesh 30 also allows for water vapor from mat 12 to enter the ventilating air. In one embodiment, the substrate material 40 affixed to the top major surface 14 of the mat 12 is air permeable to permit the free flow of any air when the mat 12 is compressed, such as during packaging. More importantly, the substrate material 40 is preferably vapor permeable so as to allow moisture to vent from the mat 12 into the ventilation air stream once installed. An example of such a substrate material is paper or non-woven fabric. Alternatively or additionally, substrate 40 may include a non-vapor-permeable material containing a plurality of perforations to facilitate vapor transfer from the mat 12 to the ventilating air stream.

The filaments or wires 42 compositely provide a resilient characteristic. In one embodiment the filaments or wires 42 comprise nylon filaments, a thermoplastic polyamide resin that may be extruded in situ and heat bonded to the underlying substrate material at randomly spaced points 41, as taught by U.S. Pat. No. 4,942,699 to Spinelli, the entirety of which is hereby incorporated by reference herein. Spinelli '699 teaches that the convoluted matrix is advantageously formed and bonded to the sheet material by extrusion of a melted polymer through articulated spinnerets. One commercial product having a matting or mesh purportedly manufactured according to Spinelli '699 is a two-layer composite including a Nylon-Polyester, non-woven, non-wicking fabric, heat bonded to a compression resistant, open nylon matting of three dimensional construction found on the ROLL VENT® Continuous Ridge Vent product available from Benjamin Obdyke of Horsham, Pa. If the non-woven fabric is not vapor-permeable, it is preferably perforated as described above. Certainly, other substrates may be used, such as perforated polyethylene film or non-woven spun-bonded polypropylene. Further, the ventilation mesh or matting 30 of the preferred embodiment preferably has a density less than that used for exterior ridge vents, as it is not intended to form a barrier to debris and pests as would be the case with a ridge vent, although the ventilation mesh or matting 30 should have sufficient rigidity so as to maintain a ventilation channel once installed.

Figure 3B:
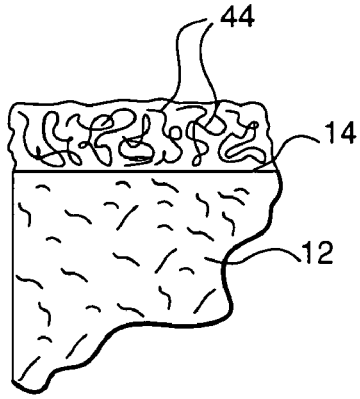
FIG. 3B is an enlarged, partial view of an alternative embodiment of the insulation product of FIG. 3.

Alternatively, the matting or ventilation mesh 30 can be coupled directly to the top major surface 14 of mat 12 as shown in FIG. 3B in the form of a unitary sheet of randomly aligned synthetic fibers 44 (e.g., nylon or polyester) that are opened and blended, randomly aligned into a web by airflow, and joined by phenolic or latex biding agents and heat cured to produce and air-permeable varying ventilation mesh. Meshes of this type are taught in U.S. Pat. No. 5,167,579 to Rotter, the entirety of which is hereby incorporated by reference herein. By "unitary", it is meant that the mat material is of unitary sheet construction, rather than sheets laminated or otherwise bonded together. In this embodiment, the matting or ventilation mesh 30 may be coupled to the top major surface 14 by a strip or strips of adhesive. Preferably, the matting or ventilation mesh 30 is coupled via strips of adhesive spaced sufficiently as to not form a barrier to moisture escaping from the mat 12 through the matting or ventilation mesh 30 and into the ventilating air stream.

Figure 4:
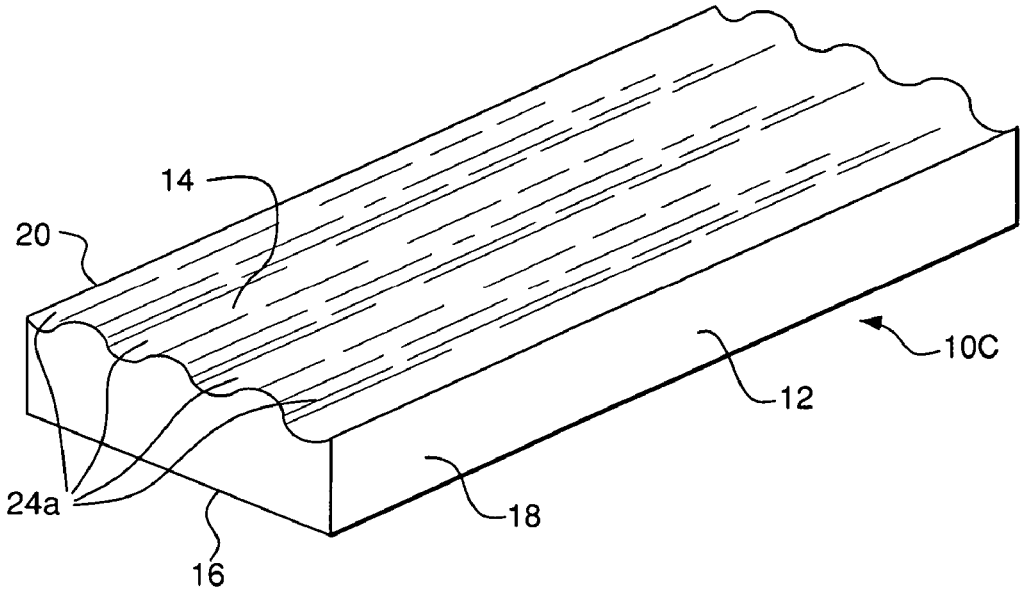
FIG. 4 is a front perspective view of an embodiment of an insulation product having a baffle surface formed therein.

FIG. 4 is a perspective view of an alternative design of a baffled insulation product 10C where the baffle is formed directly into the contour of the top major surface 14. In one embodiment, the baffle vent shape is a corrugated shape formed into the top major surface 14 along the entire length of the mat 12. The corrugated shape defines a plurality of channels 24*a* for ventilating air. Alternatively, a single open channel can be formed directly into the major surface 14 by cutting a portion of the mat 12 from the main body or molding a shape into the insulation mat, like insulation product 10 without separate baffle section 22. The corrugated shape shown in FIG. 4 may be formed by, for example, molding the shape into the mat using a shape former in the binder curing oven or using a roller to form a permanent deformation in the mat after the curing oven. Shapes other than those shown are also appropriate as long as the shape provides through-ventilation.

Figure 8:
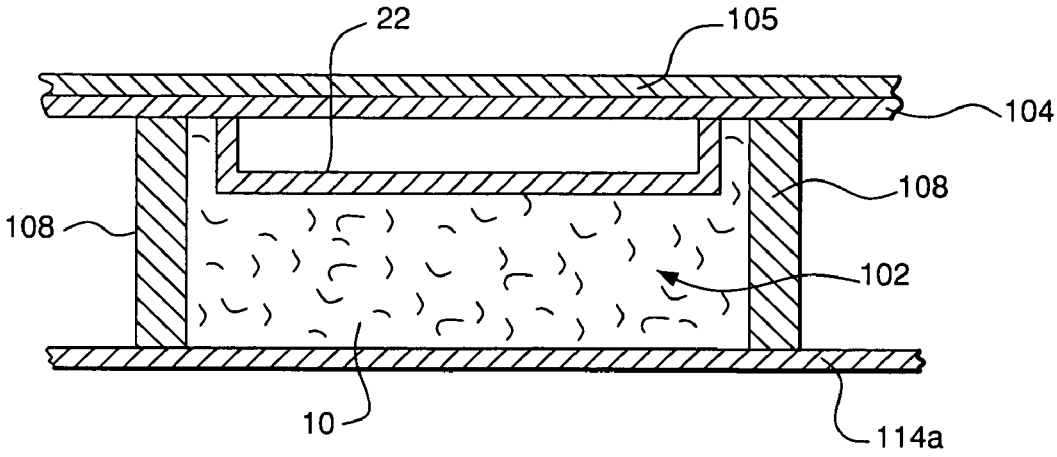
FIG. 8 is a partial cross-sectional view of the baffled insulation product of FIG. 1 installed under a roof of a structure as shown in FIG. 7 taken along lines 8-8.
Figure 7:
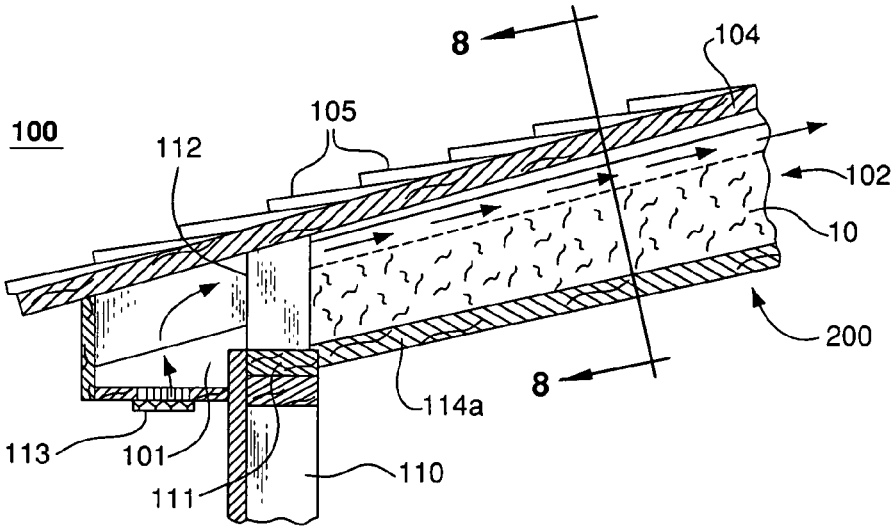
FIG. 7 is a partial side view of the baffled insulation product of FIG. 1 located under a roof of a structure and over a cathedral ceiling.

Baffled insulation products 10, 10A, 10B and 10C are preferably used with angled ceiling attic installations, such as with cathedral ceilings, as shown in, for example, the partial side view of a roofing assembly 100 in FIG. 7 and cross section of FIG. 8. Referring to FIGS. 7 and 8, baffled insulation product 10 is shown in relation to a structure or building 200, forming building assembly 100. Baffled insulation product 10 is positioned to provide a vent passage (shown in shadow) from the soffit area 101 through the attic space 102 of the building 200. Building 200 can be an industrial or residential building, including a home, garage, office and like structure. Building 200 has a conventional top wall plate 111 located on top of an upright wall 110. A generally angled cathedral ceiling 114*a* extends inwardly from top wall plate 111. Roof rafters 108 (shown in the cross section of FIG. 8) extend upwardly from top wall plate 111 and support the roof sheathing or boards 104. The structure has the conventional openings 112 between the roof sheathing 104 and the top wall plate 111 and adjacent the roof rafters 108 which provide for the movement of air from soffit area 101 to attic space 102. Soffit area 101 has a vent 113 for allowing air to move into the soffit area 101 to attic space 102. Soffit area 101 has a vent 113 for allowing air to move into the soffit area 101 from below the roof overhang. The baffled insulation product 10 when disposed below the roof sheathing or boards 104 provides an air passage space for allowing air to move from soffit area 101 to attic space 102. The baffle portion 22 of the baffled insulation product 10 allows insulation to be placed above ceiling 114*a* and adjacent to top wall plate 111. The baffle 22 extends upwardly from plate 111. The baffle 22 of the baffled insulation product 10 prevents the insulation mat 12 from inhibiting the ventilation of air through 101 attic space 102 as well as moisture that rises through mat 12 into the ventilating air stream.

Baffled insulation product 10 is installed between adjacent roof rafters 108. The roof rafters 108 are shown in FIG. 8 and are, for example, 12", 16" or 24" on center. In one embodiment, the baffle 22 is preferably shaped to have an installed convective air flow reading under 5 Pa air pressure differential of between about 35-150 CFM @ 5 Pa.

In one embodiment, the baffled insulation product may be separable longitudinally down its center, such as described in, for example, U.S. patent application Ser. No. 10/666,657 cross-referenced above and incorporated by reference herein. A single separator may be provided to the baffle 22, such as a threaded pull string, score line, weakened area, crease or longitudinal perforation (not shown) that allows the baffle 22 to be split into two pieces (e.g., in half) or into more pieces. Likewise, the underlying insulation mat 12 can be perforated longitudinally or otherwise separable, such as by comprising two or more glued longitudinal sections. The single separator of the baffle 22 is aligned with the perforation or other separation means of the mat 12 so that the insulation product can be split in half, preferably by hand, to be installed in areas where the rafters 108 may be spaced closer together. For example, a preferred insulation product 10 fits between rafters on 24" centers, which are most common. In this embodiment, the baffle 22 preferably comprises multiple channels 24, so that splitting the insulation product along its center allows at least one channel to be installed between rafters on 16" or 12" centers, which are less common.

The insulation product may also be provided with transverse separators (not shown). This feature enables the installer to save materials using shorter insulation products in applications, where, for example, the mass insulation on the attic floor is thin and/or the roof deck slopes at a high angle.

Figure 5:
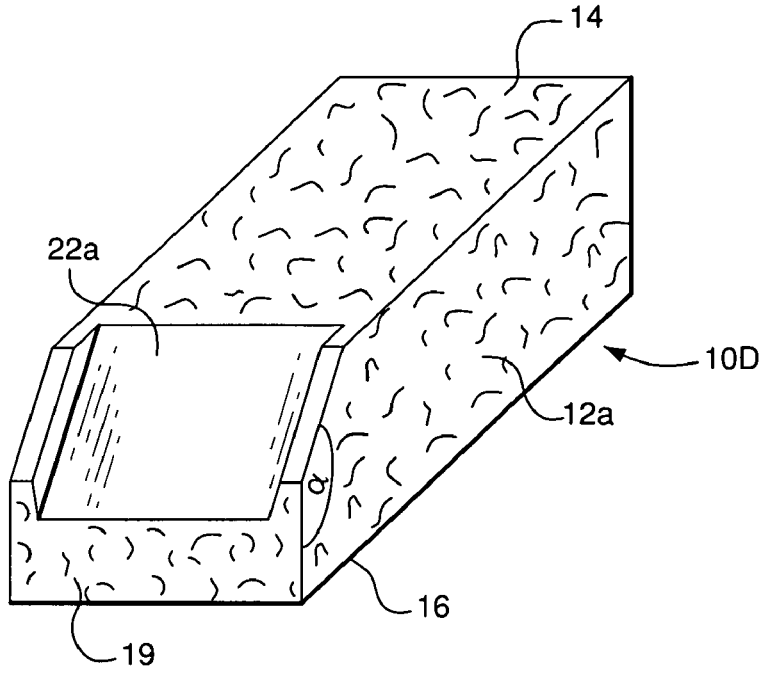
FIG. 5 is a front perspective view of an embodiment of an insulation product having an angled baffle section formed at an end thereof.
Figure 6:
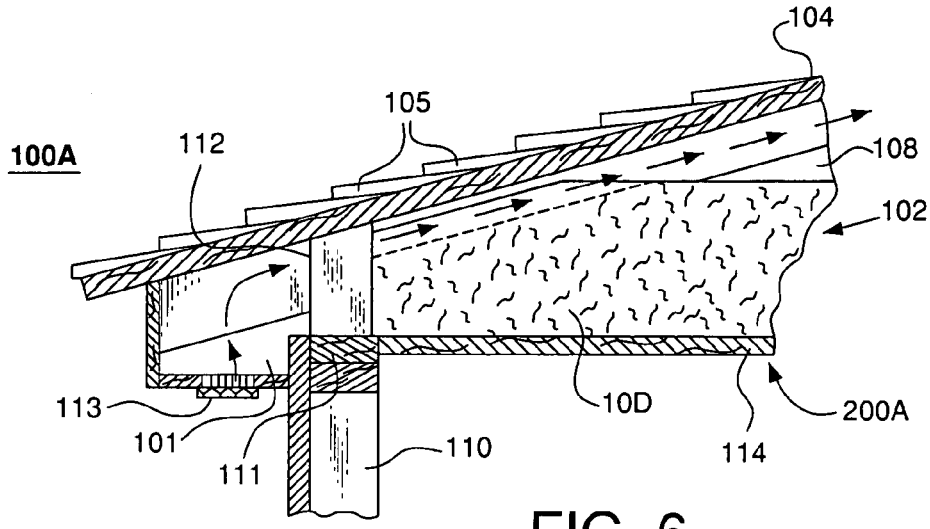
FIG. 6 is a partial side view of the baffled insulation product of FIG. 5 located under a roof of a structure.
Figure 6A:
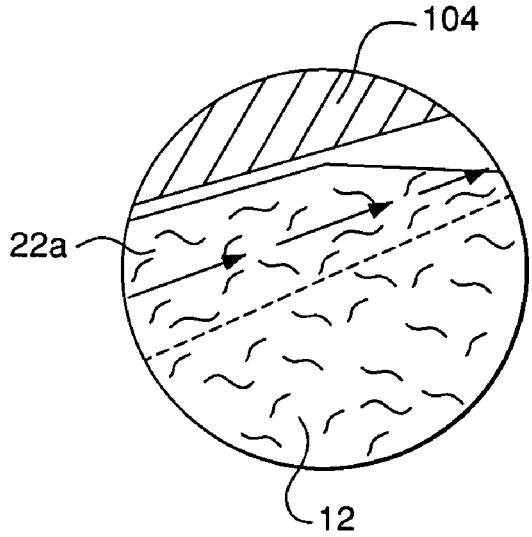
FIG. 6A is an enlarged partial view of the vented area defined by the baffled insulation product and roof structure of FIGS. 5 and 6.

In one embodiment of a baffled insulation product 10D of FIG. 5, the insulation product is configured specifically for substantially horizontal ceilings 114, as shown in the installation of FIG. 6. With reference to FIG. 5, baffled insulation product 10D has an angled baffle section 22*a* coupled to or formed into the insulation mat 12*a*. In one embodiment, the baffle 22*a* is provided at an oblique angle alpha ($\alpha$) between the vertical front face 19 and horizontal top surface 14 that matches or substantially matches (e.g., ±25°) the pitch of the roof. Baffle 22*a* may be formed directly into the insulation mat 12 or be provided in the form of a separate baffle section adhered or otherwise coupled to mat 12. In one embodiment, baffle section 22 comprises foamed plastic, such as a polypropylene, polyethylene, or polystyrene foam, an unfoamed plastic sheeting, such as PVC (polyvinylchloride), wood, sheet metal, or cardboard. As shown in the assembly 100A of FIG. 6, when installed over a horizontal roof 114 and proximate to top wall plate 111 of building 200A, the integral baffle section formed at the end of the product 10D provides for an air passage (shown in shadow) for ventilating air through attic space 102 until the sheathing 104 slopes sufficiently enough away from insulation product 10D so as to provide an open ventilation region. FIG. 6A is an enlarged partial view of the vented area defined by the baffled insulation product and roof structure of FIGS. 5 and 6. Present systems as described in the Background of the Invention Section require a separate baffle to be installed at the eaves area to provide an air channel from the eave vents to the attic space, thereby taking extra time and effort in the installation process.

Per the foregoing, a method of creating ventilating air space under a roof between a soffit area of the roof and an attic space is also provided comprising the following steps: (a) providing an insulation product as described above; (b) providing a building having an enclosed room partially defined by an outer wall, a horizontal upper top wall plate, a room ceiling, parallel inclined roof rafters, spaced from each other by a predetermined distance, supported above the top wall plate, and roof sheathing fastened on upper edges of the rafters; and (c) disposing the insulation product between a pair of adjacent roof rafters, with the top major surface of the insulation mat facing the roof sheathing, and below the roof sheathing, wherein the baffle is disposed proximate to a soffit area so as to provide for air ventilation from the soffit area to an attic space.

The baffled insulation product of the present invention greatly reduces labor and time associated with providing ventilated attic spaces. With the insulation product, no baffle need be installed separately from the chosen insulation material. The baffled insulation product promotes ventilation in the attic and other open spaces by maintaining an open ventilation channel through to the soffit area and/or to the ridge area. The insulation product also may allow for improved migration of water vapor from the insulation mat into the ventilating air stream.

Although the invention has been described in terms of exemplary embodiments, it is not limited thereto. Rather, the appended claims should be construed broadly to include other variants and embodiments of the invention that may be made by those skilled in the art without departing from the scope and range of equivalents of the invention.

What is claimed is:

1. A baffled insulation product for ventilating air under a roof from an open space, comprising:

an elongated insulation mat having top and bottom major surfaces, said top major surface facing said roof when said product is installed in said open space, said insulation mat having a baffle integral therewith proximate to said top major surface comprising at least one airflow channel for said ventilating air, wherein said baffle comprises a baffle section coupled to said top surface, said baffle section comprising an elongated member having a central panel section defining said at least one airflow channel, wherein said central panel section comprises an unfoamed sheet plastic or a foamed p1astic, wherein said elongated insulation mat has a pair of opposite end surfaces, wherein the insulation mat has a sloped surface preformed in said insulation mat to which said baffle is adhered extending between one of said end surfaces and the top major surface.

2. The baffled insulation product of claim 1, wherein said elongated insulation mat has a preformed recessed area located between longitudinal side surfaces of said insulation mat forming said sloped surface and in which said baffle is fitted.

3. The baffled insulation product of claim 1, wherein said central panel section is perforated, whereby moisture from said insulation mat can pass into said ventilating air.

4. The baffled insulation product of claim 1, wherein said unfoamed sheet plastic is selected from the group consisting of polyethylene, polyvinylchloride (PVC) or polypropylene and said foamed plastic is selected from the group consisting of polyurethane, polyolefin and polystyrene foam.

5. The baffled insulation product of claim 1, wherein said baffle section comprises top and bottom surfaces, said bottom surface oriented toward said elongated mat, said baffle section further comprising an aluminized layer thereon.

6. The baffled insulation product of claim 1, wherein said elongated insulation mat comprises randomly oriented inorganic fibers bound by an adhesive and having an R-value.

7. A baffled insulation product for ventilating air under a roof between a soffit area of said roof and an attic space, comprising:

an elongated insulation mat having top and bottom major surfaces and a pair of longitudinal side walls, said top major surface facing said roof when said product is installed in said attic space, said insulation mat having a region of reduced thickness defining a recess preformed in said mat at said top surface and defined between said pair of longitudinal side walls; and a baffle section adhered to said insulation mat in said recess, said baffle section comprising a central panel having a roof facing side and an insulation mat facing side, said central panel comprising a bottom wall portion having an integral baffle surface thereon defining at least one airflow channel for said ventilating air, wherein said central panel portion is vapor permeable.

8. The baffled insulation product of claim 7, wherein said central panel comprises perforations formed therein, whereby water vapor can escape from said insulation mat into said ventilating air.

9. The baffled insulation product of claim 7, wherein said elongated insulation mat has a pair of opposite end surfaces, said baffle section being located at an oblique angle extending between at least one of said end surfaces and said top major surface.

10. The baffled insulation product of claim 7, wherein said central panel section comprises an unfoamed sheet plastic or a foamed plastic.

11. The baffled insulation product of claim 7, wherein said elongated insulation mat comprises randomly oriented inorganic fibers bound by an adhesive and having an R-value.

12. The baffled insulation product of claim 7, wherein said central panel of said baffle section further comprises a pair of side walls extending from said bottom wall and mating with a pair of longitudinal wing portions of said insulation mat.

13. A baffled insulation product for ventilating air under a roof from an open space, comprising:

an elongated insulation mat having top and bottom major surfaces, said top major surface facing said roof when said product is installed in said open space, said insulation mat having a baffle section coupled to said top major surface comprising at least one airflow channel for said ventilating air, wherein said baffle section comprises a non-woven matting or ventilation mesh of randomly oriented filaments or wires coupled to a vapor permeable substrate layer, wherein said substrate layer is adhered to the top major surface of the insulation mat.

14. The baffled insulation product of claim 13, wherein at least some of said filaments or wires are heat bonded to said top surface.

15. The baffled insulation product of claim 13, wherein said baffle section is coupled to said top surface by an adhesive bond.

16. The baffled insulation product of claim 13, wherein said filaments or wires are bonded together by a resin binder.

17. The baffled insulation product of claim 13, wherein said filaments or wires comprise nylon.

18. The baffled insulation product of claim 9, wherein said preformed recess forms a surface to which said baffle is adhered extending between said at least one of said end surfaces and the top major surface at said oblique angle.

19. The baffled insulation product of claim 7, further comprising an adhesive layer for adhering said baffle in said recess.

20. The baffled insulation product of claim 1, wherein said baffle is meltbonded to said insulation mat.

21. The baffled insulation product of claim 7, wherein said baffle extends substantially for the entire length of said elongated insulation mat.

* * * * *

UNITED STATES PATENT AND TRADEMARK OFFICE

CERTIFICATE OF CORRECTION

PATENT NO. : 7,644,545 B2
APPLICATION NO. : 10/996225
DATED : January 12, 2010
INVENTOR(S) : Kurt O. Mankell et al.

It is certified that error appears in the above-identified patent and that said Letters Patent is hereby corrected as shown below:

Column 8, line 36, delete "p1astic" and insert therefor --plastic--

Signed and Sealed this

Fourth Day of May, 2010

David J. Kappos

David J. Kappos
*Director of the United States Patent and Trademark Office*